US012611050B2

(12) United States Patent
He

(10) Patent No.: US 12,611,050 B2
(45) Date of Patent: Apr. 28, 2026

(54) BABY BASSINET

(71) Applicant: GUANGZHOU MASTELA COMMODITY CO., LTD., Guangzhou (CN)

(72) Inventor: Yaming He, Maoming (CN)

(73) Assignee: GUANGZHOU MASTELA COMMODITY CO., LTD., Guangzhou (CN)

( * ) Notice: Subject to any disclaimer, the term of this patent is extended or adjusted under 35 U.S.C. 154(b) by 351 days.

(21) Appl. No.: 18/435,555

(22) Filed: Feb. 7, 2024

(65) Prior Publication Data

US 2024/0277159 A1 Aug. 22, 2024

(30) Foreign Application Priority Data

Feb. 17, 2023 (CN) ..... 202320251719.7

(51) Int. Cl.
*A47D 9/02* (2006.01)

(52) U.S. Cl.
CPC ..... *A47D 9/057* (2022.08)

(58) Field of Classification Search
CPC ..... A47D 9/057; A47D 9/016; A47D 9/02; F16C 29/0697; F16C 29/005; F16C 29/00; F16D 3/065
USPC ..... 5/109; 464/167
See application file for complete search history.

(56) References Cited

U.S. PATENT DOCUMENTS 4,256,095 A * 3/1981 Graham ..... A61N 1/40 5/109
4,954,120 A * 9/1990 Kobayashi ..... F16D 3/2055 464/167
5,020,170 A * 6/1991 Ruf ..... A61G 7/008 5/607
6,327,742 B1 * 12/2001 Ghouse ..... B60B 33/0042 16/29
6,350,203 B1 * 2/2002 Zernickel ..... F16C 3/035 464/167
8,212,578 B1 * 7/2012 Gajda ..... G01R 33/12 324/750.16
2010/0098358 A1 * 4/2010 Shirai ..... F16C 29/0695 384/43
2010/0126300 A1 * 5/2010 Tokioka ..... B62D 1/185 464/172

(Continued)

*Primary Examiner* — Justin C Mikowski
*Assistant Examiner* — Luke Hall
(74) *Attorney, Agent, or Firm* — HOWARD M COHN and Associates, LLC

(57) ABSTRACT

A baby bassinet includes a supporting bracket, a cradle, a sliding mechanism, and a driving mechanism. Two supporting rods are vertically arranged on an upper portion of the supporting bracket. At least one guide shaft is connected between the supporting rods. The sliding mechanism includes a connecting base, at least one housing fixed to the connecting base, and at least three rolling pieces. Two through holes are defined on two ends of the at least one housing. The at least one guide shaft passes through the through holes. The at least three rolling pieces are uniformly arranged in the at least one housing around the at least one guide shaft. The at least three rolling pieces abut against the at least one guide shaft to roll on the at least one guide shaft when the at least one housing moves relative to the at least one guide shaft.

9 Claims, 5 Drawing Sheets

(56) References Cited

U.S. PATENT DOCUMENTS

| | | | | |
|---|---|---|---|---|
| 2011/0057674 | A1* | 3/2011 | Weissacher | G01R 31/2891 324/750.16 |
| 2012/0048656 | A1* | 3/2012 | West | G01R 31/2891 187/250 |
| 2015/0094158 | A1* | 4/2015 | Mondragon | F16D 3/065 464/167 |
| 2017/0058960 | A1* | 3/2017 | Kinsella | F16D 3/2055 |
| 2017/0356487 | A1* | 12/2017 | Müntener | F16C 29/04 |
| 2020/0268168 | A1* | 8/2020 | Tully | B60B 33/00 |
| 2023/0200559 | A1* | 6/2023 | Yang | A47D 9/02 5/108 |
| 2025/0387590 | A1* | 12/2025 | Teeuwen | A47D 9/02 |

* cited by examiner

BABY BASSINET

TECHNICAL FIELD

The present disclosure relates to a technical field of infant care equipment, and in particular to a baby bassinet.

BACKGROUND

The Chinese patent application with publication No. CN217390331U discloses an automatically swinging swing device and a crib, which include a base frame, a swing mechanism, and a cradle. The swing mechanism is configured to swing the cradle, thereby reducing a burden on parents.

The swing mechanism includes a driving base, a transmission assembly, and a first boom. The transmission assembly includes a driving device, a first gear, a second gear, a third gear, a fourth gear, and a fifth gear. The gears rotate to drive the first boom to swing, thereby realizing an automatic swing of the cradle.

Although the above-mentioned automatically swinging swing mechanism realizes the automatic swing of the cradle, a structure of the automatically swinging swing mechanism is too complex, resulting in problems such as occupying an excessively large volume, being difficult to set up, and having poor stability.

SUMMARY

Based on this, a purpose of the present disclosure is to provide a baby bassinet with a simple, stable structure and a small size.

The baby bassinet includes a supporting bracket, a cradle, a sliding mechanism, and a driving mechanism.

Two supporting rods are vertically arranged on an upper portion of the supporting bracket. At least one guide shaft is connected between the two supporting rods. The sliding mechanism includes a connecting base, at least one housing, and at least three rolling pieces. The at least one housing is fixed to the connecting base. Two through holes are defined on two ends of the at least one housing. The at least one guide shaft passes through the two through holes. The at least three rolling pieces are uniformly arranged in one end of the at least one housing around a direction of the at least one guide shaft. The at least three rolling pieces abut against the at least one guide shaft to roll on the at least one guide shaft when the at least one housing moves relative to the at least one guide shaft.

The driving mechanism is arranged between the connecting base and the two supporting rods to drive the connecting base to move back and forth in an axial direction of the at least one guide shaft. The cradle is fixed on one side of the connecting base away from the at least one housing.

In the present disclosure, when the driving mechanism drives the sliding mechanism to move back and forth, the at least three rolling pieces roll back and forth along the at least one guide shaft, thereby allowing the connecting base to move smoothly along the at least one guide shaft. Therefore, a swing of the cradle is stable, and the cradle is not prone to collision and large-scale shaking. At the same time, the sliding mechanism has a simple structure and occupies a relatively small space, which reduces a size of the baby bassinet.

Optionally, two guide shafts are provided. The two guide shafts are connected between the two supporting rods. Two housings are provided. The two housings are respectively arranged an upper portion and a lower portion of the connecting base. The two guide shafts are one-to-one arranged in the two housings.

Optionally, the at least six rolling pieces are respectively arranged on two ends of the at least one housing.

Optionally, at least three accommodating grooves are defined in the at least one housing. The at least three accommodating grooves are located on an end portion of the at least one housing along a circumferential direction thereof. The at least three rolling pieces are one-to-one arranged in the at least three accommodating grooves.

Optionally, connecting grooves are defined in two opposite side walls of each of the accommodating grooves along a length direction thereof. Each of the rolling pieces includes a roller and a rotating shaft. Each rotating shaft passes through a corresponding roller. Each roller is rotatable around a corresponding rotating shaft. Two ends of each rotating shaft respectively extend into the two connecting grooves of each of the accommodating grooves.

Optionally, two ends of the at least one housing define openings. Two covers respectively cover on the two ends of the at least one housing. The through holes are defined on the two covers. At least three groups of abutting columns are uniformly distributed on an inner side of each of the covers around a corresponding through hole. The at least three groups of abutting columns are one-to-one corresponding to the at least three accommodating grooves. Each group of abutting columns includes two abutting columns. The two abutting columns thereof correspondingly extend into the two connecting grooves on the two opposite side walls of each of the accommodating grooves, and the two abutting columns thereof correspondingly abut against the two ends of each rotating shaft.

Optionally, the driving mechanism includes a driving motor, a rotating arm, and a connecting arm. The driving motor is fixed on the connecting base. An output shaft of the driving motor is fixed to a first end of the rotating arm. The connecting arm is rotatably connected to a second end of the rotating arm. One end of the connecting arm away from the rotating arm is rotatably connected to one of the two supporting rods.

Optionally, a raised portion is arranged on an upper portion of one side, away from the at least one housing, of the connecting base. A mounting base is arranged on one side of the cradle. A hanging hole is defined on the mounting base. The raised portion is configured to hook the hanging hole.

Optionally, universal wheels are arranged on a lower portion of the supporting bracket.

Compared with the prior art, the baby bassinet of the present disclosure has a simpler structure, smaller volume, stronger ability to resist collisions, and is more stable and smooth when swinging.

For better understanding and implementation, the present disclosure is described in detail below in conjunction with the accompanying drawings.

1—supporting bracket; 11—supporting rod; 12—guide shaft; 13—universal wheel; 2—cradle; 21—mounting base; 3—sliding mechanism; 31—connecting base; 32—housing; 33—accommodating groove; 34—connecting groove; 35—roller; 36—rotating shaft; 37—cover; 38—abutting column; 39—raised portion; 4—driving mechanism; 41—driving motor; 42—rotating arm; 43—connecting arm.

DETAILED DESCRIPTION

Directional terms such as "upper", "lower", "left", "right", "front", "rear", "front side", "rear side", "top", and "bottom" mentioned or may be mentioned in the specification are defined relative to structures thereof, and locations thereof are relative concepts. Therefore, the terms may change accordingly according to different locations and different usage conditions of the structures thereof. Therefore, these or other directional terms should not be construed as restrictive terms.

Implementations described in following exemplary embodiments do not represent all implementations consistent with the present disclosure. Instead, they are merely examples of implementations consistent with certain aspects of the present disclosure.

The terminology used in the present disclosure is for a purpose of describing particular embodiments only and does not limit the present disclosure. As used in the present disclosure, singular forms such as "a kind of," "said", and "the" are intended to include the plural forms as well, unless the context clearly dictates otherwise. It is also understood that the term "and/or" as used herein refers to and includes any and all possible combinations of one or more of the associated listed items.

Figure 1:
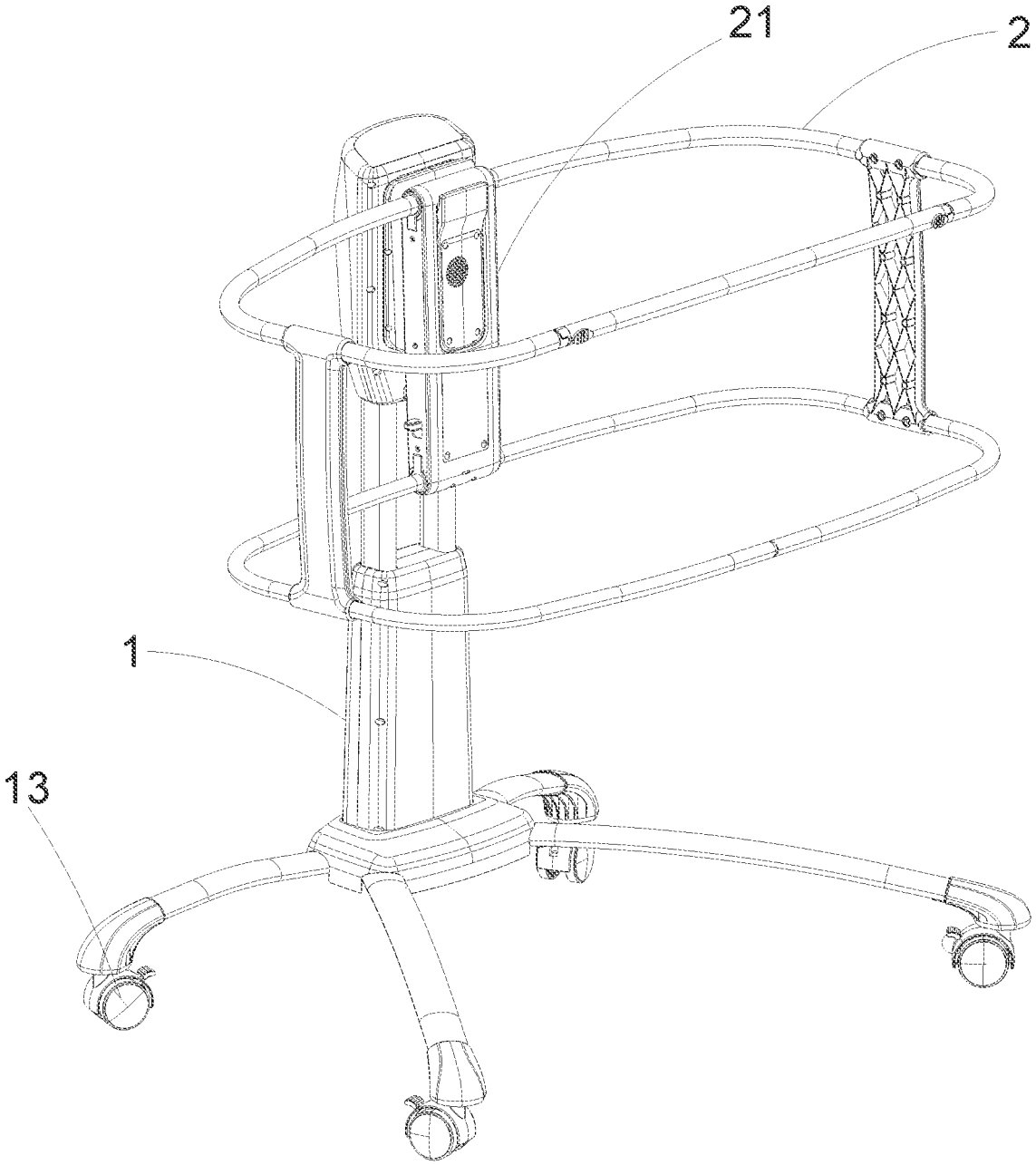
FIG. 1 is a perspective schematic diagram of a baby bassinet according to one embodiment of the present disclosure.
Figure 2:
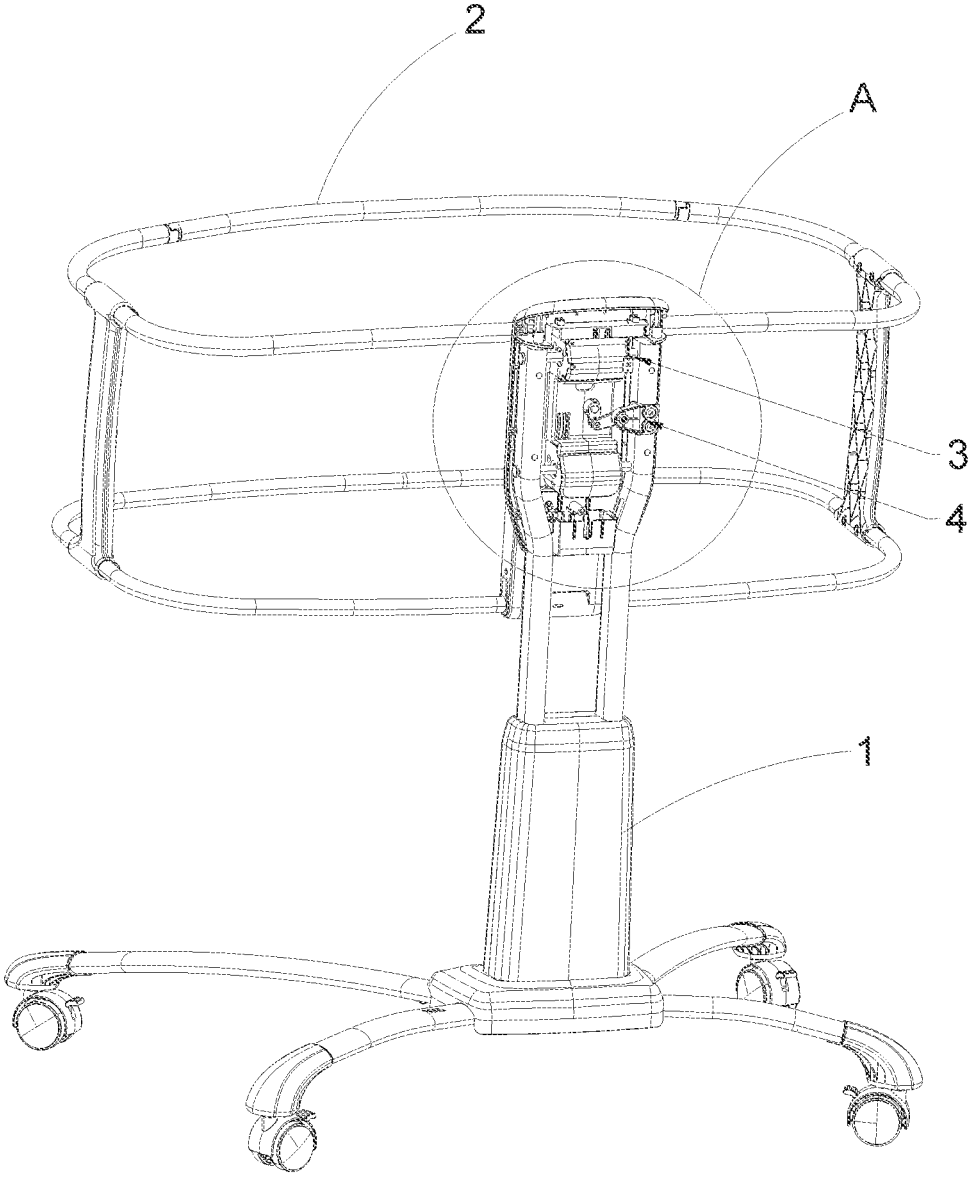
FIG. 2 is another perspective schematic diagram of a baby bassinet according to one embodiment of the present disclosure.
Figure 3:
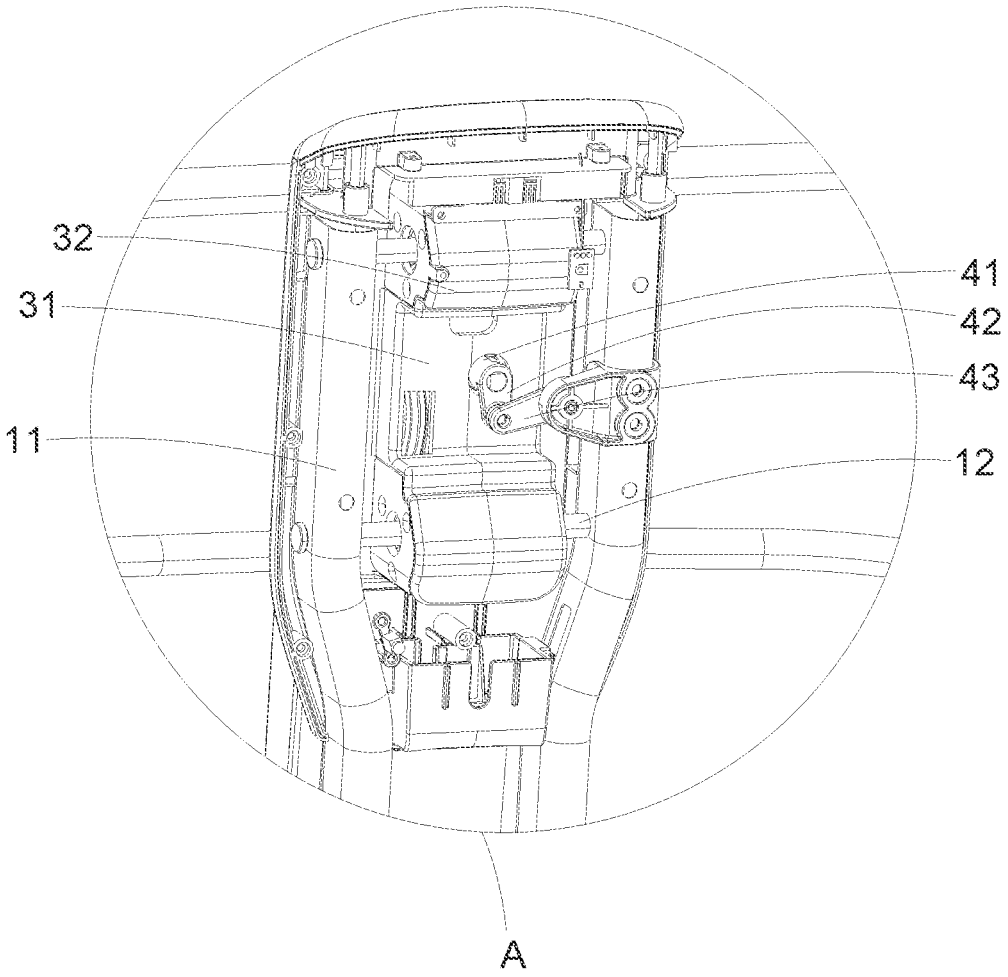
FIG. 3 is an enlarged schematic diagram of portion A shown in FIG. 2.
Figure 4:
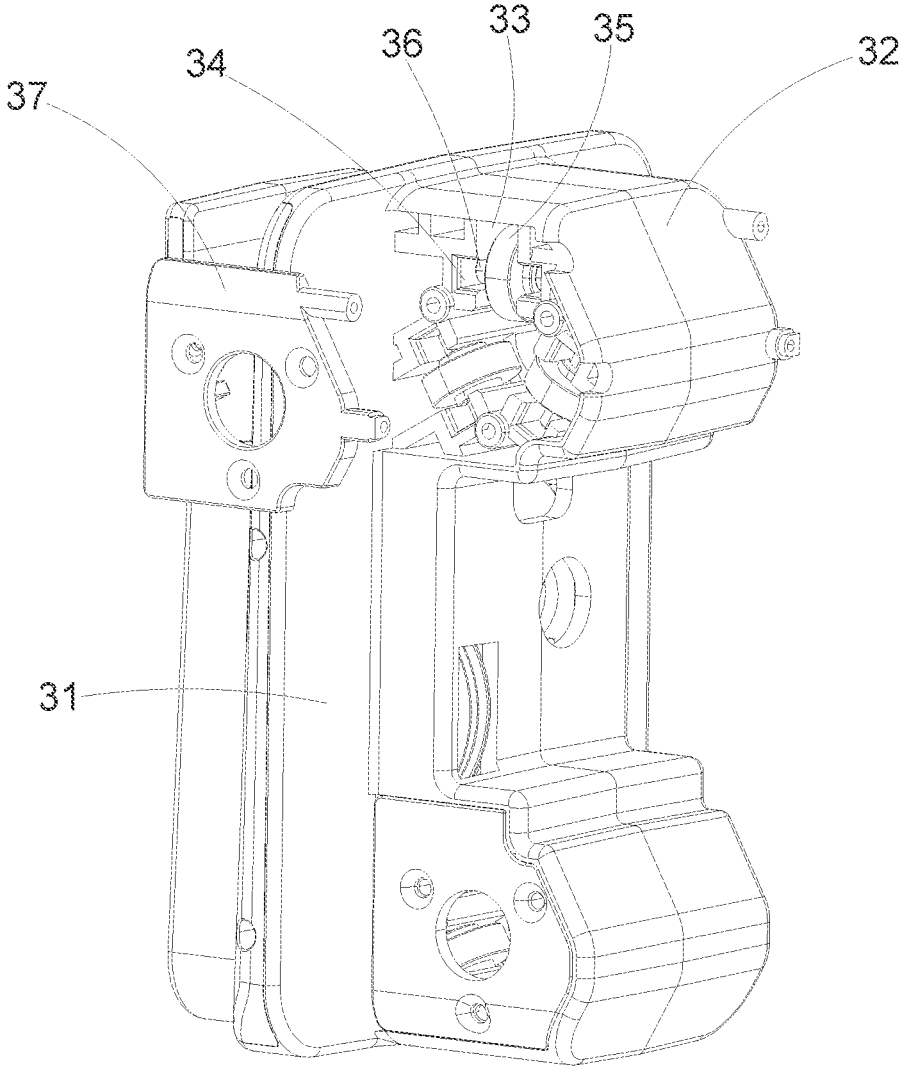
FIG. 4 is a perspective schematic diagram of a sliding mechanism according to one embodiment of the present disclosure.
Figure 5:
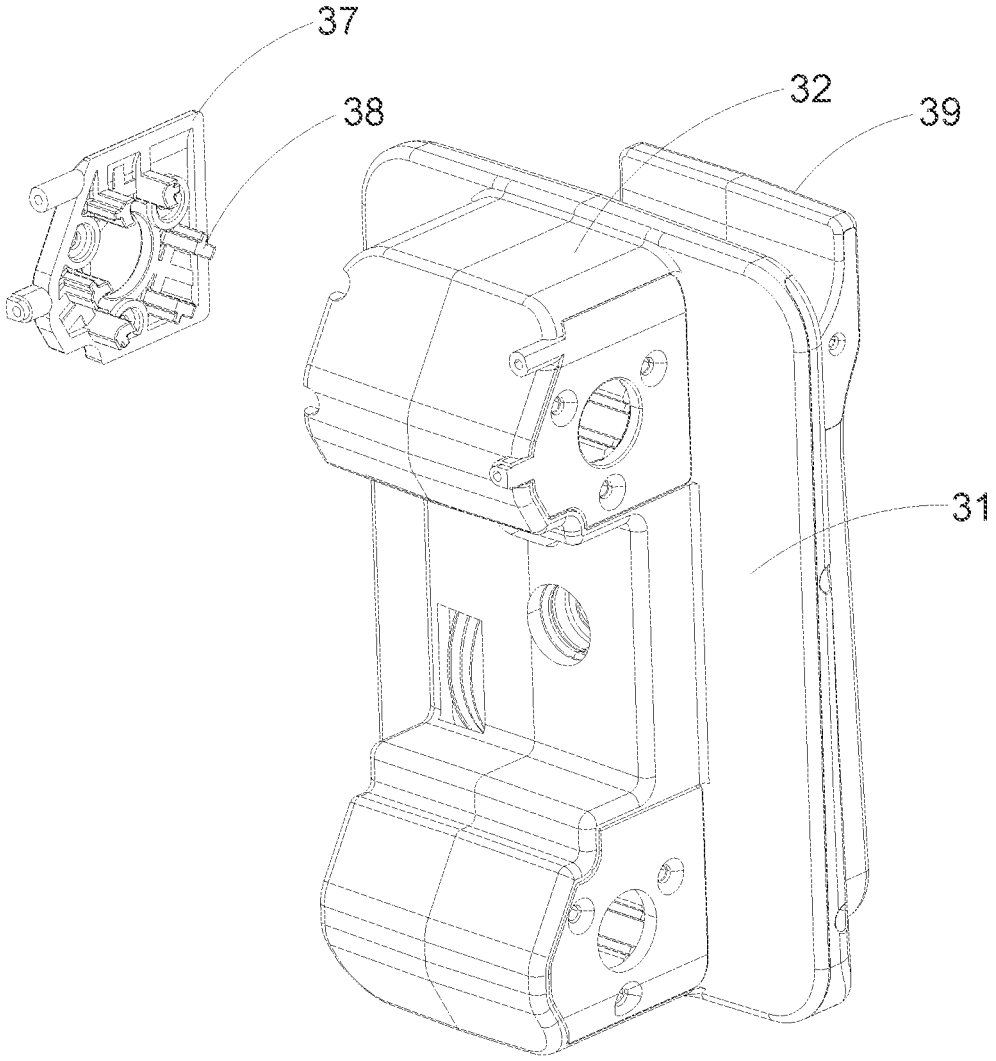
FIG. 5 is another perspective schematic diagram of a sliding mechanism according to one embodiment of the present disclosure.

As shown in FIGS. 1-5, the present disclosure provides a baby bassinet. The baby bassinet includes a supporting bracket 1, a cradle 2, a sliding mechanism 3, and a driving mechanism 4.

Two supporting rods 11 are vertically arranged on an upper portion of the supporting bracket 1. At least one guide shaft 12 is connected between the two supporting rods 11.

The sliding mechanism 3 includes a connecting base 31, at least one housing 32, and at least three rolling pieces. The at least one housing 32 is fixed to the connecting base 31. Two through holes are defined on two ends of the at least one housing 32. The at least one guide shaft 12 passes through the two through holes. The at least three rolling pieces are uniformly arranged in one end of the at least one housing 32 around a direction of the at least one guide shaft 12. The at least three rolling pieces abut against the at least one guide shaft 12 to roll on the at least one guide shaft 12 when the at least one housing 32 moves relative to the at least one guide shaft 12.

The driving mechanism 4 is arranged between the connecting base 31 and the two supporting rods 11 to drive the connecting base 31 to move back and forth in an axial direction of the at least one guide shaft 12. The cradle 2 is fixed on one side of the connecting base 31 away from the at least one housing 32.

In the present disclosure, when the driving mechanism 4 drives the sliding mechanism 3 to move back and forth, the at least three rolling pieces roll back and forth along the at least one guide shaft 12, thereby allowing the connecting base 31 to move smoothly along the at least one guide shaft 12. Therefore, a swing of the cradle 2 is stable, and the cradle 2 is not prone to collision and large-scale shaking. At the same time, the sliding mechanism 3 has a simple structure and occupies a relatively small space, which reduces a size of the baby bassinet.

In the present disclosure, two guide shafts 12 are provided. The two guide shafts 12 are connected between the two supporting rods 11. Two housings 32 are provided, and the two housings 32 are respectively arranged an upper portion and a lower portion of the connecting base 31. The two guide shafts 12 are one-to-one arranged in the two housings 32. The two guide shafts 12 play a stable guiding role at the upper portion and the lower portion of the connecting base 31 to allow the cradle 2 to swing smoothly.

At least six rolling pieces are respectively arranged on two ends of each of the housing 32. That is, at least three rolling pieces are arranged on a first end of each of the housings 32 along the circumferential direction thereof, and at least three rolling pieces are arranged on a second end of each of the housings 32 along the circumferential direction thereof, making a swing of cradle 2 stable.

In the embodiment, at least three accommodating grooves 33 are defined in each of the housings 32. The at least three accommodating grooves 33 are located on an end portion of each of the housings 32 along a circumferential direction thereof. The at least three rolling pieces arranged on the first end of each of the housings 32 are one-to-one arranged in the at least three accommodating grooves 33 of each of the housings 32. The at least three rolling pieces arranged on the second end of each of the housings 32 are one-to-one arranged in the at least three accommodating grooves 33 of each of the housings 32.

Optionally, connecting grooves 34 are defined in two opposite side walls of each of the accommodating grooves 33 along a length direction thereof. Each of the rolling pieces includes a roller 35 and a rotating shaft 36. Each rotating shaft 36 passes through a corresponding roller 35. Each roller 35 is rotatable around a corresponding rotating shaft 36. Two ends of each rotating shaft 36 respectively extend into the two connecting grooves 34 each of the accommodating grooves 33.

Optionally, two ends of each of the housings 32 define openings. Two covers 37 respectively cover on the two ends of each of the housings 32. The through holes are defined on the two covers 37. At least three groups of abutting columns are uniformly distributed on an inner side of each of the covers 37 around a corresponding through hole. The at least three groups of abutting columns are one-to-one corresponding to the at least three accommodating grooves 33 of each of the housings 32. Each group of abutting columns includes two abutting columns 38. The two abutting columns 38 thereof correspondingly extend into the two connecting grooves 34 on the two opposite side walls of each of the accommodating grooves 33, and the two abutting columns 38 thereof correspondingly abut against the two ends of each rotating shaft 36.

Therefore, during assembly, each roller 35 is placed in a corresponding accommodating groove, and the two ends of each rotating shaft 36 are correspondingly entered into two connecting grooves 34 of each of the accommodating grooves. Then, the two covers 37 of each of the housings 32 respectively cover the openings of each of the housings 32, and the two covers thereof are fixed to each of the housings through screws. Therefore, the two abutting columns 38, arranged on the inner side of each of the covers 37, of each group of abutting columns abut against a corresponding rotating shaft 36 to ensure the stability of positions of each rotating shaft 36 and each roller 35, which ensure a smooth sliding of the connecting base.

In the embodiment, the driving mechanism 4 includes a driving motor 41, a rotating arm 42, and a connecting arm 43. The driving motor 41 is fixed on the connecting base 31. An output shaft of the driving motor 41 is fixed to a first end of the rotating arm 42. The connecting arm 43 is rotatably connected to a second end of the rotating arm 42. One end of the connecting arm 43 away from the rotating arm 42 is rotatably connected to one of the two supporting rods 11.

In the embodiment, a raised portion 39 is arranged on an upper portion of one side, away from each of the housings 32, of the connecting base 31. A mounting base 21 is arranged on one side of the cradle 2. A hanging hole is defined on the mounting base. The raised portion 39 is configured to hook the hanging hole, so that the cradle is mounted on the connecting base 31.

In the embodiment, universal wheels 13 are arranged on a lower portion of the supporting bracket 1.

Compared with the prior art, the baby bassinet of the present disclosure has a simpler structure, smaller volume, stronger ability to resist collisions, and is more stable and smooth when swinging.

The above-mentioned embodiments only represent some embodiments of the present disclosure. The descriptions thereof are specific and detailed but should not be construed as a limitation of the scope of the present disclosure. It should be pointed out that for those of ordinary skill in the art, without departing from the concept of the present disclosure, modifications and improvements can be made. The modifications and the improvements belong to the protection scope of the present disclosure.

What is claimed is:

1. A baby bassinet, comprising:

a supporting bracket, a cradle, a sliding mechanism, and a driving mechanism;

wherein two supporting rods are vertically arranged on an upper portion of the supporting bracket; and at least one guide shaft is connected between the two supporting rods; the sliding mechanism comprises a connecting base, at least one housing, and at least three rolling pieces; the at least one housing is fixed to the connecting base; two through holes are defined on two ends of the at least one housing; the at least one guide shaft passes through the two through holes; the at least three rolling pieces are uniformly arranged in one end of the at least one housing around a direction of the at least one guide shaft; the at least three rolling pieces abut against the at least one guide shaft to roll on the at least one guide shaft when the at least one housing moves relative to the at least one guide shaft;

wherein the driving mechanism is arranged between the connecting base and the two supporting rods to drive the connecting base to move back and forth in an axial direction of the at least one guide shaft; the cradle is fixed on one side of the connecting base away from the at least one housing.

2. The baby bassinet according to claim 1, wherein two guide shafts are provided;

the two guide shafts are connected between the two supporting rods; two housings are provided; the two housings are respectively arranged an upper portion and a lower portion of the connecting base; the two guide shafts are one-to-one arranged in the two housings.

3. The baby bassinet according to claim 1, wherein the at least six rolling pieces are respectively arranged on two ends of the at least one housing.

4. The baby bassinet according to claim 3, wherein at least three accommodating grooves are defined in the at least one housing; the at least three accommodating grooves are located on an end portion of the at least one housing along a circumferential direction thereof; the at least three rolling pieces are one-to-one arranged in the at least three accommodating grooves.

5. The baby bassinet according to claim 4, wherein connecting grooves are defined in two opposite side walls of each of the accommodating grooves along a length direction thereof; each of the rolling pieces comprises a roller and a rotating shaft; each rotating shaft passes through a corresponding roller; each roller is rotatable around a corresponding rotating shaft; two ends of each rotating shaft respectively extend into the two connecting grooves of each of the accommodating grooves.

6. The baby bassinet according to claim 5, wherein two ends of the at least one housing define openings; two covers respectively cover on the two ends of the at least one housing; the through holes are defined on the two covers; at least three groups of abutting columns are uniformly distributed on an inner side of each of the covers around a corresponding through hole; the at least three groups of abutting columns are one-to-one corresponding to the at least three accommodating grooves; each group of abutting columns comprises two abutting columns; the two abutting columns thereof correspondingly extend into the two connecting grooves on the two opposite side walls of each of the accommodating grooves, and the two abutting columns thereof correspondingly abut against the two ends of each rotating shaft.

7. The baby bassinet according to claim 1, wherein the driving mechanism comprises a driving motor, a rotating arm, and a connecting arm; the driving motor is fixed on the connecting base; an output shaft of the driving motor is fixed to a first end of the rotating arm, the connecting arm is rotatably connected to a second end of the rotating arm; one end of the connecting arm away from the rotating arm is rotatably connected to one of the two supporting rods.

8. The baby bassinet according to claim 1, wherein a raised portion is arranged on an upper portion of one side, away from the at least one housing, of the connecting base; a mounting base is arranged on one side of the cradle; a hanging hole is defined on the mounting base; the raised portion is configured to hook the hanging hole.

9. The baby bassinet according to claim 1, wherein universal wheels are arranged on a lower portion of the supporting bracket.

* * * * *